US012366035B2

(12) United States Patent
Heiskanen et al.

(10) Patent No.: US 12,366,035 B2
(45) Date of Patent: Jul. 22, 2025

(54) MULTILAYER FILM COMPRISING MFC

(71) Applicant: Stora Enso OYJ, Helsinki (FI)

(72) Inventors: Isto Heiskanen, Imatra (FI); Kaj Backfolk, Lappeenranta (FI); Anna Kauppi, Lappeenranta (FI); Katja Lyytikäinen, Imatra (FI); Jukka Kankkunen, Imatra (FI); Juha Korvenniemi, Oriniemi (FI)

(73) Assignee: Stora Enso OYJ, Helsinki (FI)

( * ) Notice: Subject to any disclaimer, the term of this patent is extended or adjusted under 35 U.S.C. 154(b) by 274 days.

(21) Appl. No.: 18/042,124

(22) PCT Filed: Aug. 31, 2021

(86) PCT No.: PCT/IB2021/057940

§ 371 (c)(1),
(2) Date: Feb. 17, 2023

(87) PCT Pub. No.: WO2022/049482

PCT Pub. Date: Mar. 10, 2022

(65) Prior Publication Data

US 2023/0313463 A1 Oct. 5, 2023

(30) Foreign Application Priority Data

Sep. 1, 2020 (SE) ..... 2051029-3

(51) Int. Cl.

| | |
|---|---|
| ***D21H 11/08*** | (2006.01) |
| ***D21F 11/08*** | (2006.01) |
| ***D21H 11/18*** | (2006.01) |
| ***D21H 15/02*** | (2006.01) |
| ***D21H 27/30*** | (2006.01) |

(52) U.S. Cl.
CPC ..... *D21H 11/08* (2013.01); *D21F 11/08* (2013.01); *D21H 11/18* (2013.01); *D21H 15/02* (2013.01); *D21H 27/30* (2013.01)

(58) Field of Classification Search
CPC ..... D21H 11/08; D21H 11/18; D21H 15/02; D21H 27/30; D21H 27/38; D21F 11/08; B32B 29/02
See application file for complete search history.

(56) References Cited

U.S. PATENT DOCUMENTS

| | | | | |
|---|---|---|---|---|
| 9,518,364 | B2 * | 12/2016 | Heiskanen | D21H 17/675 |
| 11,124,920 | B2 * | 9/2021 | Salas Araujo | D21H 27/38 |
| 11,293,143 | B2 | 4/2022 | Hamers et al. | |
| 2015/0315747 | A1 * | 11/2015 | Heiskanen | A47L 13/16 162/158 |
| 2016/0016717 | A1 * | 1/2016 | Toubeau | D21H 17/24 220/62.13 |
| 2017/0342661 | A1 | 11/2017 | Aulin et al. | |
| 2020/0010629 | A1 | 1/2020 | Backfolk et al. | |
| 2020/0023627 | A1 | 1/2020 | Heiskanen et al. | |
| 2020/0080264 | A1 | 3/2020 | Virtanen et al. | |
| 2020/0173109 | A1 | 6/2020 | Saukkonen et al. | |
| 2023/0257937 | A1 * | 8/2023 | Heiskanen | D21F 11/00 162/358.1 |
| 2024/0191435 | A1 * | 6/2024 | Backfolk | B29C 43/26 |
| 2024/0209573 | A1 * | 6/2024 | Backfolk | D21H 19/12 |
| 2024/0376670 | A1 * | 11/2024 | Nylén | D21H 11/18 |

FOREIGN PATENT DOCUMENTS

| | | | | |
|---|---|---|---|---|
| CN | 104005267 | A | 8/2014 | |
| CN | 111566284 | A | 8/2020 | |
| EP | 2956582 | B1 * | 7/2016 | B01D 39/1607 |
| EP | 2841649 | B1 * | 12/2016 | B32B 29/005 |
| SE | 2230362 | A1 * | 5/2024 | C08J 5/18 |
| SE | 2230363 | A1 * | 5/2024 | C08J 5/18 |
| WO | 2008076056 | A1 | 6/2008 | |
| WO | 2016097964 | A1 | 6/2016 | |
| WO | WO-2017046749 | A1 * | 3/2017 | C08J 5/18 |
| WO | 2017221137 | A1 | 12/2017 | |
| WO | WO-2019008500 | A1 * | 1/2019 | B01F 23/023 |

(Continued)

OTHER PUBLICATIONS

International Search Report from corresponding PCT application No. PCT/IB2021/057940, mailed Oct. 1, 2021.
D. Fengel, Ultrastructural behaviour of cell wall polysaccharides, TAPPI, 1970, vol. 53, No. 3, pp. 497-503 (abstract only).
Gary Chinga-Carrasco, Cellulose fibres, nanofibrils and microfibrils: The morphological sequence of MFC components from a plant physiology and fibre technology point of view, Chinga-Carrasco Nanoscale Research Letters, 2011, 6:417.
Extended European Search Report from corresponding European application No. 2186304.7, dated Sep. 20, 2024.

*Primary Examiner* — Jose A Fortuna

(74) *Attorney, Agent, or Firm* — Greer, Burns & Crain, Ltd.

(57) ABSTRACT

The present invention relates to a method for manufacturing a multilayer film comprising microfibrillated cellulose (MFC) in a paper-making machine, the method comprising the steps of: a) forming a bottom web layer by applying a first pulp suspension comprising at least 50% by dry weight of cellulose based fibrous material having an SR (Schopper-Riegler) value in the range of 18-75 on a bottom web wire; b) forming or applying an intermediate web layer formed from a second pulp suspension comprising at least 50% by dry weight of MFC having an SR value in the range of 80-100 on the bottom web layer; c) applying a top web layer formed from a third pulp suspension comprising at least 50% by dry weight of cellulose based fibrous material having an SR (Schopper-Riegler) value in the range of 18-75 on the intermediate web layer to form a multilayer web; and d) dewatering, and optionally drying, the formed multilayer web to obtain a multilayer film comprising MFC.

14 Claims, No Drawings

(56) References Cited

FOREIGN PATENT DOCUMENTS

| | | | | | |
|---|---|---|---|---|---|
| WO | 2019123405 | A1 | | 6/2019 | |
| WO | WO-2019123191 | A1 | * | 6/2019 | B32B 27/10 |
| WO | 2020157609 | A1 | | 8/2020 | |
| WO | 2020160603 | A1 | | 8/2020 | |
| WO | WO-2021260608 | A1 | * | 12/2021 | B82Y 30/00 |
| WO | WO-2022219378 | A1 | * | 10/2022 | |
| WO | WO-2023047216 | A1 | * | 3/2023 | B82Y 30/00 |
| WO | WO-2024084132 | A1 | * | 4/2024 | B29C 44/06 |
| WO | WO-2024100565 | A1 | * | 5/2024 | C08L 1/02 |
| WO | WO-2024100568 | A1 | * | 5/2024 | D21H 11/18 |
| WO | WO-2024218566 | A1 | * | 10/2024 | D21F 1/028 |

* cited by examiner

MULTILAYER FILM COMPRISING MFC

This application is a U.S. National Phase under 35 U.S.C. § 371 of International Application No. PCT/IB2021/057940 filed Aug. 31, 2021, which claims priority under 35 U.S.C. §§ 119 and 365 to Swedish Application No. 2051029-3 filed Sep. 1, 2020.

TECHNICAL FIELD

The present disclosure relates to gas barrier films, e.g. useful in paper and paperboard based packaging materials. More specifically, the present disclosure relates to methods for manufacturing films comprising highly refined cellulose fibers, particularly films comprising microfibrillated cellulose (MFC).

BACKGROUND

Effective gas, aroma, and/or moisture barriers are required in packaging industry for shielding sensitive products. Particularly, oxygen-sensitive products require an oxygen barrier to extend their shelf-life. Oxygen-sensitive products include many food products, but also pharmaceutical products and electronic industry products. Known packaging materials with oxygen barrier properties may be comprised of one or several polymer films or of a fibrous paper or board coated with one or several layers of an oxygen barrier polymer, usually as part of a multilayer coating structure. Another important property for packaging for food products is resistance to grease and oil.

More recently, microfibrillated cellulose (MFC) films have been developed, in which defibrillated cellulosic fibrils have been suspended e.g. in water, re-organized and rebonded together to form a continuous film. MFC films have been found to provide good gas barrier properties as well as good resistance to grease and oil.

MFC films can be made by applying an MFC suspension on a porous substrate forming a web followed by dewatering of the web by draining water through the substrate for forming the film. Formation of the web can be accomplished e.g. by use of a paper- or paperboard machine type of process. The porous substrate may for example be a membrane or wire fabric or it can be a paper or paperboard substrate.

Manufacturing of films and barrier substrates from highly refined cellulose or MFC suspensions with very slow drainage is difficult on a paper machine since it is difficult to create good barriers due to occurrence of pinholes. Pinholes are microscopic holes that can appear in the web during the forming process. Examples of reasons for the appearance of pinholes include irregularities in the pulp suspension, e.g. formed by flocculation or re-flocculation of fibrils, rough dewatering fabric, uneven pulp distribution on the wire, or too low web grammage. Pinhole formation typically increases with increased dewatering speed. However, in pinhole free areas, the Oxygen Transmission Rate value is good when grammage is above 20-40 g/m$^2$.

MFC films are typically relatively weak, and the films are therefore often formed or laminated with one or more additional supporting layers to improve the mechanical strength. However, due to the shrinking properties of the MFC films, the forming or lamination with other cellulose based layers may often result in problems with curling of the formed multilayer structure.

Furthermore, the high water retention and low water permeability of the MFC suspension and wet web can cause problems with water drainage when forming multilayer structures. The low water permeability of the MFC film can prevent water from being removed from other layers of the multilayer structure, which can lead to delamination or bubble formation.

One solution to overcome this problem is to form the MFC layer by coating a relatively dry substrate with an MFC suspension and then drying the substrate. Unfortunately, since the MFC suspension is typically relatively wet, this solution can cause problems with rewetting of the substrate.

Another possibility is wet on dry lamination, where a wet MFC containing ply is laminated onto a dry substrate. However, in this case the curl and asymmetrical shrinking must be controlled by other means such as coating the backside with MFC. This leads to extra re-wetting without gaining any extra barrier properties.

From a technical and economical point of view, it would be preferable to find a solution that enables fast dewatering, and at the same time improves either the film mechanical properties or barrier properties, or both.

DESCRIPTION OF THE INVENTION

It is an object of the present disclosure to provide a method for manufacturing a film comprising highly refined cellulose fibers, such as microfibrillated cellulose (MFC), which alleviates at least some of the above mentioned problems associated with prior art methods.

It is a further object of the present disclosure to provide an improved method for manufacturing a film comprising highly refined cellulose fibers in a paper- or paperboard machine type of process.

It is a further object of the present disclosure to provide a film useful as gas barrier in a paper or paperboard based packaging material which is based on renewable raw materials.

It is a further object of the present disclosure to provide a film useful as gas barrier in a paper or paperboard based packaging material with high repulpability, providing for high recyclability of packaging products comprising the film.

The above-mentioned objects, as well as other objects as will be realized by the skilled person in the light of the present disclosure, are achieved by the various aspects of the present disclosure.

The inventive method allows for efficient manufacturing a multilayer film comprising microfibrillated cellulose in a paper machine type of process. Such films have been found to be very useful as gas barrier films, e.g. in packaging applications. The films can be used to replace conventional barrier films, such as synthetic polymer films or aluminum foils which reduce the recyclability of paper or paperboard packaging products. The inventive films have high repulpability, providing for high recyclability of the films and paper or paperboard packaging products comprising the films.

According to a first aspect illustrated herein, there is provided a method for manufacturing a multilayer film comprising microfibrillated cellulose (MFC) in a papermaking machine, the method comprising the steps of:

a) forming a bottom web layer by applying a first pulp suspension comprising at least 50% by dry weight of cellulose based fibrous material having an SR (Schopper-Riegler) value in the range of 18-75 on a bottom web wire;

b) forming or applying an intermediate web layer formed from a second pulp suspension comprising at least 50% by dry weight of MFC having an SR value in the range of 80-100 on the bottom web layer;

c) applying a top web layer formed from a third pulp suspension comprising at least 50% by dry weight of cellulose based fibrous material having an SR (Schopper-Riegler) value in the range of 18-75 on the intermediate web layer to form a multilayer web; and d) dewatering, and optionally drying, the formed multilayer web to obtain a multilayer film comprising MFC.

The term film as used herein refers generally to a thin continuous sheet formed material. Depending on the composition of the pulp suspension, the film can also be considered as a thin paper or even as a membrane.

The multilayer film can be used as such, or it can be combined with one or more other layers. The film is for example useful as a barrier layer in a paperboard based packaging material. The film may also be or constitute a barrier layer in glassine, greaseproof paper or a thin packaging paper.

Although different arrangements for performing the steps of the inventive method could be contemplated by the skilled person, the inventive method may advantageously be performed in a paper machine, more preferably in a Fourdrinier paper machine.

A paper machine (or paper-making machine) is an industrial machine which is used in the pulp and paper industry to create paper in large quantities at high speed. Modern paper-making machines are typically based on the principles of the Fourdrinier Machine, which uses a moving woven mesh, a "wire", to create a continuous web by filtering out the fibers held in a pulp suspension and producing a continuously moving wet web of fiber. This wet web is dried in the machine to produce paper or film.

The forming and dewatering steps of the inventive method are preferably performed at the forming section of the paper machine, commonly called the wet end.

The wet webs are formed on different wires in the forming section of the paper machine. The preferred type of forming section for use with the present invention includes 2 or 3 Fourdrinier wire sections, combined with supporting wire. The wires are preferably endless wires. The wire used in the inventive method preferably has relatively high porosity in order to allow fast dewatering and high drainage capacity. The air permeability of the wire is preferably above 5000 $m^3/m^2$/hour at 100 Pa. The wire used in the inventive method preferably has relatively high porosity in order to allow fast dewatering and high drainage capacity). The wire preferably has a high fibre support index (F.S.I), typically above 190 so that fine material does not penetrate into the structure and to cause less wire markings, and a coarse and open back side. The wire section of a paper machine may have various dewatering devices such as blade, table and/or foil elements, suction boxes, friction less dewatering, ultrasound assisted dewatering, couch rolls, or a dandy roll.

In the inventive method an intermediate web layer formed from a pulp suspension comprising at least 50% by dry weight of MFC having a high water retention value is formed between two outer layers formed from a pulp suspension comprising less refined cellulose based fibrous material having a lower water retention value.

The inventive method comprises forming a bottom web layer by applying a first pulp suspension comprising at least 50% by dry weight of cellulose based fibrous material having an SR value in the range of 18-75 on a bottom web wire.

The inventive method further comprises forming or applying an intermediate web layer formed from a second pulp suspension comprising at least 50% by dry weight of MFC having an SR value in the range of 80-100 on the bottom web layer.

The first and second layers can be formed separately, on different wires, or together, on the same wire.

The bottom web layer is preferably partially dewatered before the intermediate web layer is formed or applied. Thus, in some embodiments, the method comprises the steps:

a1) forming a bottom web layer by applying a first pulp suspension comprising at least 50% by dry weight of cellulose based fibrous material having an SR (Schopper-Riegler) value in the range of 18-75 on a bottom web wire; and a2) partially dewatering the bottom web layer.

The intermediate web layer is formed from a second pulp suspension comprising at least 50% by dry weight of MFC having an SR value in the range of 80-100. The intermediate layer is formed or applied on the bottom web layer. This means that in some embodiments, the intermediate web layer is formed directly on the bottom web layer by applying the second pulp suspension on the wet or partially dried bottom web layer. In other embodiments, the intermediate web layer is formed separately, e.g. on a separate wire, partially dewatered and subsequently wet laminated onto the bottom web layer.

In some embodiments, the intermediate web layer of step b) is formed by applying a second pulp suspension comprising at least 50% by dry weight of MFC having an SR value in the range of 80-100 onto the bottom web layer. The second pulp suspension can be applied using various methods, including, but not limited to spraying or curtain coating. When using these types of deposition techniques, the application can be made in a single deposition step or using multiple deposition steps in order to get more even quality and not disturbing the formation of the bottom web layer. Application of the second pulp suspension can for example be achieved using at least two consecutive spraying or curtain coating units applying same or substantially the pulp suspension.

The dry solids content of the second pulp suspension applied to the bottom web layer can vary within a wide range depending on the technique used for deposition of the suspension. The dry solids content of the second pulp suspension applied to the bottom web layer may generally be in the range of 0.1-5 wt %. When the second pulp suspension is applied using a headbox, the dry solids content may typically be lower. The dry solids content of the second pulp suspension applied to the bottom web layer is typically in the range of 0.1-0.7 wt %, preferably in the range of 0.15-0.5 wt %, more preferably in the range of 0.2-0.4 wt %.

The water of the second pulp suspension can be removed by drainage through the less drainage resistant bottom web layer, or by drying, or by a combination thereof. The drainage and/or drying of the second pulp suspension results in the formation of the intermediate web layer on the bottom web layer.

Dewatering of the webs on the wire may be performed using methods and equipment known in the art. Examples include but are not limited to table roll and foils, friction less dewatering and ultra-sound assisted dewatering.

Partial dewatering means that the dry solids content of the wet web is reduced compared to the dry solids content of the pulp suspension, but that the dewatered web still comprises a significant amount of water. In some embodiments, partial dewatering of the wet web means that the dry solids content of the partially dewatered web is above 1 wt % but below 15 wt %. In some embodiments, partial dewatering of the wet web means that the dry solids content of the partially dewatered web is above 1 wt % but below 10 wt %. A dry solids content of the partially dewatered webs in this range has been found to be especially suitable for joining the wet webs into a multilayer web. In some embodiments, the dry solids content of the partially dewatered web layers prior to lamination is in the range of 1.5-8 wt %, preferably in the range of 2.5-6 wt %, and more preferably in the range of 3-4.5 wt %.

In some embodiments, the intermediate web layer of step b) is formed simultaneously with the bottom web layer of step a), e.g. using a multilayer headbox or two headboxes arranged at the same wire. In some embodiments, the bottom web layer of step a) and the intermediate web layer of step b) are formed simultaneously using a multilayer headbox. The lower drainage resistance of the bottom web layer allows water to be removed by drainage through the bottom web layer and wire.

In an alternative embodiment, the bottom web layer and the intermediate web layer are formed separately on different wires, and subsequently joined by wet lamination. Thus, in some embodiments, the step b) comprises:

b1) forming an intermediate web layer by applying a second pulp suspension comprising at least 50% by dry weight of MFC having an SR value in the range of 80-100 on an intermediate web wire;

b2) partially dewatering the intermediate web layer; and b3) applying the partially dewatered intermediate web layer to the bottom web layer.

In some embodiments, the dry solids content of the partially dewatered intermediate web layer is in the range of 1.5-8 wt %, preferably in the range of 2.5-6 wt %, and more preferably in the range of 3-4.5 wt %.

In some embodiments, the bottom web layer is also partially dewatered. In some embodiments, the dry solids content of the partially dewatered bottom web layer is in the range of 1.5-8 wt %, preferably in the range of 2.5-6 wt %, and more preferably in the range of 3-4.5 wt %.

The top web layer is preferably formed and partially dewatered on a top web wire separately from the bottom web layer and intermediate web layer and subsequently applied to the partially dewatered top web layer to the intermediate web layer to form the multilayer web. The partial dewatering of the top web layer reduces the problems of draining water through the low permeability intermediate web layer. This prevents delamination or bubble formation of the multilayer web.

Thus, in some embodiments step c) of the method comprises:

c1) forming a top web layer by applying a third pulp suspension comprising at least 50% by dry weight of cellulose based fibrous material having an SR (Schopper-Riegler) value in the range of 18-75 on a top web wire;

c2) partially dewatering the top web layer; and c3) applying the partially dewatered top web layer to the intermediate web layer to form the multilayer web.

In some embodiments, the dry solids content of the partially dewatered top web layer is in the range of 1.5-8 wt %, preferably in the range of 2.5-6 wt %, and more preferably in the range of 3-4.5 wt %.

The partially dewatered webs are preferably joined by wet lamination. When the pulp suspension is dewatered on the wire a visible boundary line will appear at a point where the web goes from having a reflective water layer to where this reflective layer disappears. This boundary line between the reflective and non-reflective web is referred to as the waterline. The waterline is indicative of a certain solids content of the web. The webs are preferably joined after the water line. Joining the webs while they are still wet ensures good adhesion between the layers. The joining can be achieved by applying one of the partially dewatered webs on top of the other. The joining may be done non-wire side against non-wire side, or wire-side against non-wire side. Joining and further dewatering of the formed multilayer web may be improved by various additional operations. In some embodiments, the joining further comprises pressing the partially dewatered webs together. In some embodiments, the joining further comprises applying suction to the joined partially dewatered webs. Applying pressure and/or suction to the formed multilayer web improves adhesion between the web layers.

Joining the webs while they are still wet ensures good adhesion between the layers. The partial dewatering and lamination of the webs in the partially dewatered state has been found to substantially eliminate occurrence of pinholes in the finished multilayer film, while still allowing a high production speed. In the prior art, increased dewatering speed has sometimes been achieved by using large amounts of retention and drainage chemicals at the wet end of the process, causing increased flocculation. However, retention and drainage chemicals may also cause a more porous web structure, and thus there is a need to minimize the use of such chemicals. The inventive method provides an alternative way of increasing dewatering speed, which is less dependent on the addition of retention and drainage chemicals. In some embodiments, the second pulp suspension is free from added retention and drainage chemicals.

The dry solids content of the multilayer web is typically further increased when the partially dewatered top web layer has been applied. The increase in dry solids content may be due to dewatering of the multilayer web on the wire with optional pressure and/or suction applied to the web, and also due to drying operations performed during or shortly after the joining, e.g. impingement drying or air or steam drying. The dry solids content of the multilayer web after joining, with optional application of pressure and/or suction, is typically above 8 wt % but below 28 wt %. In some embodiments, the dry solids content of the multilayer web prior to the further dewatering and optional drying step is in the range of 8-28 wt %, preferably in the range of 10-20 wt %, and more preferably in the range of 12-18 wt %.

The formed multilayer web, is subsequently further dewatered and optionally dried to obtain a multilayer film comprising MFC. In the dewatering and optional drying step d), the dry solids content of the multilayer web is further increased. The resulting multilayer film preferably has a dry solids content above 90 wt %.

The further dewatering typically comprises pressing the multilayer web to squeeze out as much water as possible. The further dewatering may for example include passing the formed multilayer web through a press section of a paper machine, where the web passes between large rolls loaded under high pressure to squeeze out as much water as possible. In some embodiments the further dewatering comprises passing the web through one or more shoe presses. The removed water is typically received by a fabric or felt. In some embodiments, the dry solids content of the multilayer film after the further dewatering is in the range of 15-48 wt %, preferably in the range of 18-40 wt %, and more preferably in the range of 22-35 wt %.

The optional drying may for example include drying the multilayer web by passing the multilayer web around a series of heated drying cylinders. Drying may typically remove the water content down to a level of about 1-15 wt %, preferably to about 2-10 wt %. In some embodiments, the drying comprises drying the web on a Yankee cylinder. The Yankee cylinder can also be used to produce a glazed surface on the finished film.

It was found that the combination of a dewatering in one or more shoe presses followed by drying in a Yankee cylinder made it possible to dewater and dry the multilayer film in a very efficient way, i.e. at high speed and good runnability, without destroying the barrier properties of the multilayer film.

The dry solids content of the final multilayer film may vary depending on the intended use of the film. For example a multilayer film for use as a stand-alone product may have a dry solids content in the range of 85-99 wt %, preferably in the range of 90-98 wt %, whereas a film for use in further lamination to form paper or paperboard based packaging material may have a dry solids content in the range of less than 90 wt %, preferably less than 85 wt %, such as in the range of 30-85 wt %.

The first and third pulp suspensions are aqueous suspensions comprising a water-suspended mixture of cellulose based fibrous material and optionally non-fibrous additives. The pulps can be produced from different raw materials, for example selected from the group consisting of bleached or unbleached softwood pulp or hardwood pulp, Kraft pulp, pressurized groundwood pulp (PGW), thermomechanical (TMP), chemi-thermomechanical pulp (CTMP), neutral sulfite semi chemical pulp (NSSC), broke or recycled fibers.

The pulp suspensions can be unrefined or refined. Refining, or beating, of cellulose pulps refers to mechanical treatment and modification of the cellulose fibers in order to provide them with desired properties. The cellulose based fibrous material of the first and third pulp suspensions has an SR (Schopper-Riegler) value in the range of 18-75. In some embodiments, the cellulose based fibrous material of the first and third pulp suspensions has an SR value in the range of 18-70.

The dry solids content of the first and/or third pulp suspension is typically in the range of 0.1-0.7 wt %, preferably in the range of 0.15-0.5 wt %, more preferably in the range of 0.2-0.4 wt %.

The dry solids content of the first and/or third pulp suspension may be comprised solely of the cellulose based fibrous material, or it can comprise a mixture of cellulose based fibrous material and other ingredients or additives.

The first and/or third pulp suspension preferably includes the cellulose based fibrous material as its main component based on the total dry weight of the pulp suspension. In some embodiments, the first and/or third pulp suspension comprises at least 50% by dry weight, preferably at least 70% by dry weight, more preferably at least 80% by dry weight or at least 90% by dry weight of the cellulose based fibrous material, based on the total dry weight of the pulp suspension.

In some embodiments, the first and/or third pulp suspension is a Kraft pulp suspension. Refined Kraft pulp will typically comprise at least 10% by dry weight of hemicellulose. Thus, in some embodiments the first and/or third pulp suspension comprises hemicellulose at an amount of at least 10% by dry weight, such as in the range of 10-25% by dry weight, based on the amount of the cellulose based fibrous material.

The first and/or third pulp suspension may further comprise additives such as native starch or starch derivatives, cellulose derivatives such as sodium carboxymethyl cellulose, a filler, retention and/or drainage chemicals, flocculation additives, deflocculating additives, dry strength additives, softeners, cross-linking aids, sizing chemicals, dyes and colorants, wet strength resins, fixatives, de-foaming aids, microbe and slime control aids, or mixtures thereof. The first and/or third pulp suspension may further comprise additives that will improve different properties of the mixture and/or the produced film such as latex and/or polyvinyl alcohol (PVOH) for enhancing the ductility of the film. The inventive method provides an alternative way of increasing dewatering speed, which is less dependent on the addition of retention and drainage chemicals, but smaller amounts of retention and drainage chemicals may still be used.

In some embodiments, the first and/or third pulp suspension comprises a hydrophobizing chemical such as AKD, ASA or rosin size in an amount of 0-10 kg/ton, preferably 0.1-5 kg/ton and more preferably 0.2-2 kg/ton based on the total dry weight of the pulp suspension.

In some embodiments, the first and/or third pulp suspension comprises thermoplastic particles or fibers, such as PLA or PVOH fibers, to provide heat sealability. In some embodiments, the first and/or third pulp suspension comprises thermoplastic particles or fibers in an amount 5-50% by dry weight, preferably 10-50% by dry weight, more preferably 15-50% by dry weight, based on the total dry weight of the pulp suspension.

In some embodiments, the first and/or third pulp suspension comprises mechanical pulp to give the film a natural look.

To prevent curl upon further dewatering and drying of the formed multilayer web, the bottom and top web layers should preferably exhibit the same or similar shrinkage during dewatering or drying. In preferred embodiments the same or similar shrinkage can be achieved by using the same pulp and grammage for the bottom and top web layers. Of course, the same or similar shrinkage may also be achieved by using different pulps, but adjusting the grammage or including additives to get the same or similar shrinkage.

In some embodiments, the first and third pulp suspensions are identical. In some embodiments, the SR values of the first and third pulp suspensions differ by less than 30%, preferably by less than 25% and more preferably by less than 20%.

In some embodiments, the bottom and top web layers have the same or similar composition and basis weight.

In some embodiments, the dry basis weight of the bottom and top web layers is in the range of 20-120 gsm, preferably in the range of 20-100 gsm, more preferably in the range of 20-80 gsm.

The second pulp suspension is an aqueous suspension comprising a water-suspended mixture of cellulose based fibrous material and optionally non-fibrous additives. The pulps can be produced from different raw materials, for example softwood pulp or hardwood pulp.

The second pulp suspension is more refined than the first and third pulp suspensions and comprises at least 50% by dry weight of microfibrillated cellulose (MFC). The MFC of the second pulp suspension has an SR (Schopper-Riegler) value in the range of 80-100. In some embodiments, the MFC of the second pulp suspension has an SR value in the range of 80-98. In some embodiments, the MFC of the second pulp suspension has an SR value in the range of 85-98.

The SR value of the second pulp suspension is significantly higher than the SR value of the first and third pulp suspensions. More specifically, the SR value of the second pulp suspension is preferably at least 10 SR units, more preferably at least or at least 30 SR units higher than the SR value of the first and third pulp suspensions.

The dry solids content of the second pulp suspension applied to the bottom web layer can vary within a wide range depending on the technique used for deposition of the suspension. The dry solids content of the second pulp suspension applied to the bottom web layer may generally be in the range of 0.1-5 wt %. When the second pulp suspension is applied using a headbox, the dry solids content may typically be lower. The dry solids content of the second pulp suspension is typically in the range of 0.1-0.7 wt %, preferably in the range of 0.15-0.5 wt %, more preferably in the range of 0.2-0.4 wt %.

The dry solids content of the second pulp suspension may be comprised solely of the MFC, or it can comprise a mixture of the MFC and other ingredients or additives.

The second pulp suspension preferably includes the MFC as its main component based on the total dry weight of the pulp suspension. Having a high dry content of the MFC in the second pulp suspension ensures good barrier properties in the finished film. In some embodiments, the second pulp suspension comprises at least 50% by dry weight, preferably at least 70% by dry weight, more preferably at least 80% by dry weight or at least 90% by dry weight of MFC, based on the total dry weight of the pulp suspension. In some embodiments, the second pulp suspension comprises in the range of 50-99% by dry weight, preferably in the range of 70-99% by dry weight, more preferably in the range of 80-99% by dry weight, and more preferably in the range of 90-99% by dry weight of MFC, based on the total dry weight of the pulp suspension.

In some embodiments, the second pulp suspension is a highly refined Kraft pulp suspension. Refined Kraft pulp will typically comprise at least 10% by dry weight hemicellulose. Thus, in some embodiments the first and/or third pulp suspension comprises hemicellulose at an amount of at least 10% by dry weight, such as in the range of 10-25% by dry weight, of the amount of the MFC.

The second pulp suspension may further comprise additives such as native starch or starch derivatives, cellulose derivatives such as sodium carboxymethyl cellulose, a filler, flocculation additives, deflocculating additives, dry strength additives, softeners, cross-linking aids, sizing chemicals, dyes and colorants, wet strength resins, fixatives, de-foaming aids, microbe and slime control aids, or mixtures thereof. The second pulp suspension may further comprise additives that will improve different properties of the mixture and/or the produced film such as latex and/or polyvinyl alcohol (PVOH) for enhancing the ductility of the film. The inventive method provides an alternative way of increasing dewatering speed, which is less dependent on the addition of retention and drainage chemicals, but smaller amounts of retention and drainage chemicals may still be used. In some embodiments, the second pulp suspension is free from added retention and drainage chemicals.

Having a high dry content of the MFC in the second pulp suspension ensures good barrier properties in the finished film. Thus, the second pulp suspension preferably comprises no more than 20% by dry weight of additives in total, based on the total dry weight of the pulp suspension. More preferably the second pulp suspension preferably comprises no more than 10% by dry weight of additives in total, based on the total dry weight of the pulp suspension.

In some embodiments, the second pulp suspension comprises up to 20% by dry weight, preferably up to 10% by dry weight, of a filler, e.g. bentonite, based on the total dry weight of the pulp suspension.

In addition to the MFC, the second pulp suspension may also comprise a certain amount of unrefined or slightly refined cellulose fibers. The term unrefined or slightly refined fibers as used herein preferably refers to cellulose fibers having a Schopper-Riegler (SR) value below 30, preferably below 28, as determined by standard ISO 5267-1. Unrefined or slightly refined cellulose fibers are useful to enhance dewatering and may also improve strength and fracture toughness of the multilayer film. In some embodiments, the second pulp suspension comprises 0.1-50% by dry weight, preferably 0.1-30% by dry weight, and more preferably 0.1-10% by dry weight of unrefined or slightly refined cellulose fibers, based on the total dry weight of the pulp suspension. The unrefined or slightly refined cellulose fibers may for example be obtained from bleached or unbleached or mechanical or chemimechanical pulp or other high yield pulps.

The pH value of the second pulp suspension may typically be in the range of 4-10 preferably in the range of 5-8, and more preferably in the range of 5.5-7.5.

The temperature of the second pulp suspension may typically be in the range of 30-70° C., preferably in the range of 40-60° C., and more preferably in the range of 45-55° C.

Microfibrillated cellulose (MFC) shall in the context of the patent application be understood to mean a nano scale cellulose particle fiber or fibril with at least one dimension less than 1000 nm. MFC comprises partly or totally fibrillated cellulose or lignocellulose fibers. The liberated fibrils typically have a diameter less than 100 nm, whereas the actual fibril diameter or particle size distribution and/or aspect ratio (length/width) depends on the source and the manufacturing methods. The smallest fibril is called elementary fibril and has a diameter of approximately 2-4 nm (see e.g. Chinga-Carrasco, G., *Cellulose fibres, nanofibrils and microfibrils: The morphological sequence of MFC components from a plant physiology and fibre technology point of view, Nanoscale research letters* 2011, 6:417), while it is common that the aggregated form of the elementary fibrils, also defined as microfibril (Fengel, D., *Ultrastructural behavior of cell wall polysaccharides, Tappi J.*, March 1970, Vol 53, No. 3.), is the main product that is obtained when making MFC e.g. by using an extended refining process or pressure-drop disintegration process. Depending on the source and the manufacturing process, the length of the fibrils can vary from around 1 to more than 10 micrometers. A coarse MFC grade might contain a substantial fraction of fibrillated fibers, i.e. protruding fibrils from the tracheid (cellulose fiber), and with a certain amount of fibrils liberated from the tracheid (cellulose fiber).

There are different acronyms for MFC such as cellulose microfibrils, fibrillated cellulose, nanofibrillated cellulose, fibril aggregates, nanoscale cellulose fibrils, cellulose nanofibers, cellulose nanofibrils, cellulose microfibers, cellulose fibrils, microfibrillar cellulose, microfibril aggregates and cellulose microfibril aggregates. MFC can also be characterized by various physical or physical-chemical properties such as its large surface area or its ability to form a gel-like material at low solids (1-5 wt %) when dispersed in water.

Various methods exist to make MFC, such as single or multiple pass refining, pre-hydrolysis followed by refining or high shear disintegration or liberation of fibrils.

One or several pre-treatment steps are usually required in order to make MFC manufacturing both energy efficient and sustainable. The cellulose fibers of the pulp to be utilized may thus be pre-treated, for example enzymatically or chemically, to hydrolyse or swell the fibers or to reduce the quantity of hemicellulose or lignin. The cellulose fibers may be chemically modified before fibrillation, such that the cellulose molecules contain other (or more) functional groups than found in the native cellulose. Such groups include, among others, carboxymethyl (CMC), aldehyde and/or carboxyl groups (cellulose obtained by N-oxyl mediated oxidation, for example "TEMPO"), quaternary ammonium (cationic cellulose) or phosphoryl groups. After being modified or oxidized in one of the above-described methods, it is easier to disintegrate the fibers into MFC or nanofibrils.

The nanofibrillar cellulose may contain some hemicelluloses, the amount of which is dependent on the plant source. Mechanical disintegration of the pre-treated fibers, e.g. hydrolysed, pre-swelled, or oxidized cellulose raw material is carried out with suitable equipment such as a refiner, grinder, homogenizer, colloider, friction grinder, ultrasound sonicator, fluidizer such as microfluidizer, macrofluidizer or fluidizer-type homogenizer. Depending on the MFC manufacturing method, the product might also contain fines, or nanocrystalline cellulose, or other chemicals present in wood fibers or in papermaking process. The product might also contain various amounts of micron size fiber particles that have not been efficiently fibrillated.

MFC is produced from wood cellulose fibers, both from hardwood and softwood fibers. It can also be made from microbial sources, agricultural fibers such as wheat straw pulp, bamboo, bagasse, or other non-wood fiber sources. It is preferably made from pulp including pulp from virgin fiber, e.g. mechanical, chemical and/or thermomechanical pulps. It can also be made from broke or recycled paper.

The intermediate web layer preferably has a lower grammage than the top and bottom web layers. In some embodiments, the dry basis weight of the intermediate web layer is in the range of 5-60 gsm (grams per square meter), preferably in the range of 10-40 gsm, and more preferably in the range of 20-40 gsm.

In some embodiments, the dry basis weight of the formed multilayer web and multilayer film is in the range of 45-300 gsm, preferably in the range of 50-200 gsm, more preferably in the range of 50-150 gsm.

The invention is described herein mainly with reference to an embodiment wherein the multilayer film is formed from three web layers. However, it is understood that the multilayer film may also comprise additional web layers. Thus, it is also possible that the formed multilayer film is formed from three or more web layers, such as three, four, five, six, or seven web layers.

In some embodiments, the geometrical tear index of the multilayer film is above 7 $mNm^2/g$, preferably above 8.5 $mNm^2/g$, more preferably above 9.5 $mNm^2/g$. As a comparison, a single layer film made of 100% MFC may typically have a geometrical tear index in the range of 4-5.5 $mNm^2/g$.

In some embodiments, the burst index of the multilayer film is above 1 $kPam^2/g$, preferably above 1.5 $kPam^2/g$, more preferably above 2 $kPam^2/g$.

Pinholes are microscopic holes that can appear in the web during the forming process. Examples of reasons for the appearance of pinholes include irregularities in the pulp suspension, e.g. formed by flocculation or re-flocculation of fibrils, rough dewatering fabric, uneven pulp distribution on the wire, or too low a web grammage. In some embodiments, the multilayer film comprises less than 10 pinholes/$m^2$, preferably less than 8 pinholes/$m^2$, and more preferably less than 2 pinholes/$m^2$, as measured according to standard EN13676:2001. The measurement involves treating the multilayer film with a coloring solution (e.g. dyestuff E131 Blue in ethanol) and inspecting the surface microscopically.

The multilayer film will typically exhibit good resistance to grease and oil. Grease resistance of the multilayer film is evaluated by the KIT-test according to standard ISO 16532-2. The test uses a series of mixtures of castor oil, toluene and heptane.

As the ratio of oil to solvent is decreased, the viscosity and surface tension also decrease, making successive mixtures more difficult to withstand. The performance is rated by the highest numbered solution which does not darken the sheet after 15 seconds. The highest numbered solution (the most aggressive) that remains on the surface of the paper without causing failure is reported as the "kit rating" (maximum 12). In some embodiments, the KIT value of the multilayer film is at least 8, preferably at least 10, as measured according to standard ISO 16532-2.

In some embodiments, the multilayer film has a Gurley Hill value of at least 10 000 s/100 ml, preferably at least 25000 s/100 ml, and more preferably at least 40 000 s/100 ml, as measured according to standard ISO 5636/6.

In some embodiments, the multilayer film has an oxygen transfer rate (OTR), measured according to the standard ASTM D-3985 at 50% relative humidity and 23° C., of less than 100 $cc/m^2/24$ h/atm, preferably less than 50 $cc/m^2/24$ h/atm, more preferably less than 20 $cc/m^2/24$ h/atm.

The multilayer film preferably has high repulpability. In some embodiments, the multilayer film exhibits less than 30%, preferably less than 20%, and more preferably less than 10% reject, when tested as a category II material according to the PTS-RH 021/97 test method.

According to a second aspect illustrated herein, there is provided a multilayer film comprising MFC, wherein the multilayer film is obtainable by the inventive method.

The inventive multilayer films are especially suited as thin packaging films when coated or laminated with one or more layers of a thermoplastic polymer. Thus, the multilayer film may preferably be coated or laminated with one or more polymer layers.

The multilayer film may be provided with a polymer layer on one side or on both sides. The polymer layer may of course interfere with repulpability, but may still be required or desired in some applications. Polymer layers may for example be applied by extrusion coating, film lamination or dispersion coating.

The polymer layer may comprise any of the thermoplastic polymers commonly used in paper or paperboard based packaging materials in general or polymers used in liquid packaging board in particular. Examples include polyethylene (PE), polyethylene terephthalate (PET), polypropylene (PP), polyhydroxyalkanoates (PHA), polylactic acid (PLA), polyglycolic acid (PGA), starch and cellulose. Polyethylenes, especially low density polyethylene (LDPE) and high density polyethylene (HDPE), are the most common and versatile polymers used in liquid packaging board.

Thermoplastic polymers, are useful since they can be conveniently processed by extrusion coating techniques to form very thin and homogenous films with good liquid barrier properties. In some embodiments, the polymer layer comprises polypropylene or polyethylene. In preferred embodiments, the polymer layer comprises polyethylene, more preferably LDPE or HDPE.

The polymer layer may comprise one or more layers formed of the same polymeric resin or of different polymeric resins. In some embodiments the polymer layer comprises a mixture of two or more different polymeric resins. In some embodiments the polymer layer is a multilayer structure comprised of two or more layers, wherein a first layer is comprised of a first polymeric resin and a second layer is comprised of a second polymeric resin, which is different from the first polymeric resin.

In some embodiments, the polymer layer is formed by extrusion coating of the polymer onto a surface of the multilayer film. Extrusion coating is a process by which a molten plastic material is applied to a substrate to form a very thin, smooth and uniform layer. The coating can be formed by the extruded plastic itself, or the molten plastic can be used as an adhesive to laminate a solid plastic film onto the substrate. Common plastic resins used in extrusion coating include polyethylene (PE), polypropylene (PP), and polyethylene terephthalate (PET).

The basis weight of each polymer layer of the multilayer film is preferably less than 50 g/m$^2$. In order to achieve a continuous and substantially defect free film, a basis weight of the polymer layer of at least 8 g/m$^2$, preferably at least 12 g/m$^2$ is typically required. In some embodiments, the basis weight of the polymer layer is in the range of 8-50 g/m$^2$, preferably in the range of 12-50 g/m$^2$.

Generally, while the products, polymers, materials, layers and processes are described in terms of "comprising" various components or steps, the products, polymers, materials, layers and processes can also "consist essentially of" or "consist of" the various components and steps.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

EXAMPLES

Tests on a pilot paper/paperboard machine were performed. Two- or three-layered structures were produced at a speed of 20 m/min. The web layers were formed on separate wires and then combined before pressing and drying. The grease barrier behavior of the produced structures, both flat and creased and folded, was evaluated using standard ASTM F119-82 method with palm kernel oil.

Example 1

A three-layer structure was successfully produced using the pilot machine. The bottom web layer was formed from 100% birch pulp having an SR-value of 28 and had a dry basis weight of 40 gsm. The intermediate web layer was formed from 100% MFC and had a dry basis weight of 32 gsm. The top web layer was formed from 100% birch pulp having an SR-value of 28 and had a dry basis weight of 60 gsm.

The solid content after the wire and before press section was 20%. After three press steps the solid content was 32%. The bonding between the different layers was excellent. Surprisingly, no curling was observed in the three-layer structure. The grease resistance was measured to be 2-5 h for the flat structure and 5-6 h for the creased and folded structure, which is considered as good since the web was not coated.

Example 2 (Comparative)

As a comparative example, the grease barrier behavior of an uncoated commercial three-ply board having a basis weight of 247 gsm was tested with the same method. The grease resistance was less than 15 min for both flat and folded samples.

The invention claimed is:

1. A method for manufacturing a multilayer film comprising microfibrillated cellulose (MFC) in a paper-making machine, the method comprising the steps of:

a) forming a bottom web layer by applying a first pulp suspension comprising at least 50% by dry weight of cellulose based fibrous material having an SR (Schopper-Riegler) value in a range of 18-75 on a bottom web wire;

b) forming or applying an intermediate web layer formed from a second pulp suspension comprising at least 50% by dry weight of MFC having an SR value in a range of 80-100 on the bottom web layer;

c) applying a top web layer formed from a third pulp suspension comprising at least 50% by dry weight of cellulose based fibrous material having an SR value in a range of 18-75 on the intermediate web layer to form a multilayer web; and d) dewatering the formed multilayer web to obtain a multilayer film comprising MFC, wherein step b) comprises:

b1) forming the intermediate web layer by applying the second pulp suspension on an intermediate web wire;

b2) partially dewatering the intermediate web layer; and b3) applying the partially dewatered intermediate web layer to the bottom web layer.

2. The method according to claim 1, wherein step a) comprises:

a1) forming the bottom web layer by applying the first pulp suspension on the bottom web wire; and a2) partially dewatering the bottom web layer.

3. The method according to claim 1, wherein the bottom web layer of step a) and the intermediate web layer of step b) are formed simultaneously.

4. The method according to claim 1, wherein step c) comprises:

c1) forming the top web layer by applying the third pulp suspension on the top web wire;

c2) partially dewatering the top web layer; and c3) applying the partially dewatered top web layer to the intermediate web layer to form the multilayer web.

5. The method according to claim 4, wherein a dry solids content of the partially dewatered top web layer is in a range of 1.5-8 wt %.

6. The method according to claim 1, wherein the cellulose based fibrous material of the first and third pulp suspensions has an SR value in a range of 18-70.

7. The method according to claim 1, wherein the MFC of the second pulp suspension has an SR value in a range of 85-98.

8. The method according to claim 1, wherein the bottom and top web layers exhibit a same shrinkage during dewatering or drying.

9. The method according to claim 1, wherein the bottom and top web layers have a same composition and basis weight.

10. The method according to claim 1, wherein a dry basis weight of the bottom and top web layers is in a range of 20-120 gsm.

11. The method according to claim 1, wherein a dry basis weight of the intermediate web layer is in a range of 5-60 gsm.

12. The method according to claim 1, wherein a geometrical tear index of the multilayer film is >7 $mNm^2/g$.

13. The method according to claim 1, wherein a burst index of the film is >1 $kPam^2/g$.

14. The method according to claim 1, wherein step d) further comprises dewatering and drying the formed multilayer web to obtain the multilayer film comprising MFC.

* * * * *